US008627774B2

(12) United States Patent
Pearce

(10) Patent No.: US 8,627,774 B2
(45) Date of Patent: Jan. 14, 2014

(54) GROUND LOCK

(76) Inventor: Cordell Pearce, Denver, CO (US)

( * ) Notice: Subject to any disclaimer, the term of this patent is extended or adjusted under 35 U.S.C. 154(b) by 305 days.

(21) Appl. No.: 12/976,779

(22) Filed: Dec. 22, 2010

(65) Prior Publication Data

US 2012/0160139 A1 Jun. 28, 2012

(51) Int. Cl.
*E05G 1/00* (2006.01)

(52) U.S. Cl.
USPC ..... 109/45; 52/157; 52/165; 70/218; 109/50; 109/52; 135/72; 135/118; 248/156; 248/530; 248/545; 248/552

(58) Field of Classification Search
USPC ..... 70/218, 222, 223; 109/45, 50–52; 292/DIG. 27; 248/530, 545, 551–553, 248/156; 135/65, 72, 16, 118; 52/157, 165
See application file for complete search history.

(56) References Cited

U.S. PATENT DOCUMENTS

| | | | | | |
|---|---|---|---|---|---|
| 369,500 | A * | 9/1887 | Brookbank | 256/56 |
| 1,193,725 | A * | 8/1916 | Smith | 52/157 |
| 3,848,367 | A * | 11/1974 | Barnes | 52/157 |
| 4,454,824 | A * | 6/1984 | Wood | 109/52 |
| 4,664,041 | A | 5/1987 | Wood | |
| 5,199,361 | A * | 4/1993 | Robinson | 109/51 |
| 5,740,684 | A * | 4/1998 | Sherlock et al. | 70/58 |
| 5,819,720 | A * | 10/1998 | Schubert | 126/41 R |
| 5,881,978 | A * | 3/1999 | Rust | 248/156 |
| 6,032,880 | A * | 3/2000 | Verrills et al. | 248/530 |
| 6,082,157 | A * | 7/2000 | Boyce | 70/58 |
| 6,082,697 | A * | 7/2000 | Grunfeld | 248/508 |
| 7,409,915 | B2 | 8/2008 | Hagar | |
| 7,980,185 | B1 * | 7/2011 | Teague, Jr. | 109/50 |
| 2005/0211282 | A1 * | 9/2005 | DeVenezia et al. | 135/16 |

* cited by examiner

*Primary Examiner* — Lloyd Gall
(74) *Attorney, Agent, or Firm* — Kyle W. Rost

(57) ABSTRACT

A ground lock is formed of a main shaft having a first latching structure near its upper end and a ground fastener at its lower end. A mating member provides a cooperative latching structure and slides on the main shaft between raised and lowered positions. In one of the raised or lowered positions, the two latching structures are latchable, allowing the mating member to drive the main shaft to engage or disengage the ground fastener. In the other of the raised or lowered positions, the second latching structure is non-latchable with the first latching structure such that the main shaft is disabled from driving the ground fastener.

18 Claims, 8 Drawing Sheets

GROUND LOCK

BACKGROUND OF THE INVENTION

1. Field of the Invention

The invention generally relates to safes, bank protection, and related devices, especially supports and mountings. The invention discloses a ground lock, especially a beach lock equipped with a device for anchoring the lock in sand, plus a joining device that permits personal property to be secured to the lock.

2. Description of Related Art Including Information Disclosed Under 37 CFR 1.97 and 1.98

Visitors to a beach often establish a base site where they deposit blankets, towels, coolers, chairs, umbrellas and other paraphernalia that the party of visitors plans to enjoy during their visit. However, visits to the beach often involve group ventures into the water or down the beach to play sports. Such group ventures can draw everyone in the party away from the base site, leaving the deposited paraphernalia unprotected against theft.

A ground lock, beach lock, or sand lock is a device that can be secured in sand and used as an anchor or locker for protecting personal property against theft. Several devices of this type have been proposed.

U.S. Pat. No. 7,409,915 to Hagar proposes a beach lock that is composed of an auger with a square lug box at its top end for driving the auger into sand, using a separate lug wrench to twist the auger by the square lug box. For added security, the square lug box has a free spinning post mounted in its top and adapted to receive a padlock. A dome fits on the free spinning post and covers the square lug box, so that the lug box can't be engaged by the lug wrench to unscrew the auger. The padlock is above the dome and holds the dome over the lug box, as well as providing an anchor for attaching valuables to the padlock shackle. With the dome in place, even a thief carrying a lug wrench would have difficulty extracting the auger from the sand. Therefore, this security system appears to be effective, although it has the considerable disadvantage of requiring a great deal of hardware including a lug wrench for installation and then requiring some sort of disposition of the lug wrench, itself, until the time comes to remove the beach lock.

U.S. Pat. No. 4,664,041 to Wood proposes a beach locker in which an auger is driven into the beach sand using a lug wrench to turn a lug at the top end of the auger shaft. Then a box or locker is fitted over the top end of the auger shaft, and a keeper is applied to the lug, securing the lug and keeper inside the box. By simply locking the box, the lug and keeper are secured against tampering. In addition, the box serves as a locker that can hold valuables. A special configuration of lug wrench can serve as a hasp that participates in locking the box, solving the dilemma of where to store the lug wrench during the day at the beach. However, this beach locker apparently requires the visitors to haul a great deal of heavy hardware to and from the beach, in addition to the usual paraphernalia of such excursions.

Wood further proposes an alternative embodiment of the beach locker in which the locker box is attached to the auger shaft on a reversible ratchet mechanism. This would allow the locker box to be turned for driving the auger into the sand, but the ratchet would freewheel in reverse. The ratchet control would be locked inside the box so that it could only be reversed when the box is open. This solution may eliminate the need for a separate lug wrench but still requires that a considerable amount of hardware be hauled to and from the beach.

It would be desirable to improve the efficiency of material usage in a sand lock that provides good security against unauthorized removal. In particular, a desirable sand lock should provide security without requiring that excessive hardware accompany the sand lock. Such features of the prior art as a protective dome or locker box should not be necessary for a desirable sand lock to perform its protective and anchoring function.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide a ground lock or sand lock that is efficient in construction to allow easy carrying and use.

In brief overview, the invention is a ground lock or sand lock that when installed in the ground leaves a top handle at or near ground level for use in locking a bicycle, surfboard, purses, wallets and other personal property. The handle may have a swivel on the end so that it can lie flat once installed. The handle may be painted in a florescent color so that it is highly noticeable by potential thieves and by passing pedestrians. The handle can occupy either of two positions with respect to an anchor portion of the sand lock. The handle is temporarily joined or latched to the anchor portion in a first position by a temporarily engaged latching mechanism, which includes a disengageable portion such as a padlock. The sand lock is then installed by the end user by screwing it into the ground via the handle, acting through the temporary latching mechanism. Once the sand lock has been installed, the temporary latching mechanism is disengaged, such as by removing the padlock. The handle is then moved to a second position with respect to the anchor portion. In the second position, the handle rotates freely, preventing the anchor portion from being removed from the ground. A temporary fastener such as a padlock is then engaged with the latching mechanism that was employed in the first position, now locking-out the handle from returning to the first position. Thus, the sand lock is prevented from being removed from the ground except by the user who is able to re-actuate the latching mechanism, such as by removing the padlock to allow the handle to return to first position.

According to the invention, a ground lock provides an attachment for securing an external object. The ground lock is formed of a vertically elongated main shaft having upper and lower ends. A ground fastener is fixed to the lower end of the main shaft and is configured to alternatively engage or disengage the ground when suitably driven. The main shaft has a first latching structure near its upper end. An attachment member includes a second latching structure that slidably engages the main shaft and is moveable between a raised position and a lowered position. When in one of the two positions, such as the lowered position, the second latching structure is latchable with the first latching structure such that the attachment member can drivingly engage the main shaft to suitably drive the ground fastener. When in the second of the two positions, such as the raised position, the second latching structure is non-latchable with the first latching structure such that the main shaft is disabled from suitably driving the ground fastener to alternatively engage or disengage the ground.

According to another aspect of the invention, a ground lock is formed of a lock-driving shaft having opposite proximal and distal ends. The lock-driving shaft carries a ground fastener near its distal end. A driver sleeve is telescopically engaged over the lock-driving shaft and is slidable between a first position at a first height on the lock-driving shaft and a second position at a second height on the lock-driving shaft. The lock-driving shaft defines a first transverse bore near its proximal end, suited, in use, to receive a through pin. The driver sleeve defines a catch suited, in use, to latch with a through pin and is alignable with the first transverse bore when the sleeve is in the first position on the lock-driving shaft. When the driver sleeve is in the second position, the first transverse bore and the catch are offset from one another at different heights. At least one of the bore or catch is clear to be locked independently of the other. Consequently, in use in the first position, a transverse pin placed through the first bore of the lock-driving shaft is latchable with the catch of the driver sleeve to form a rotationally latched engagement between the lock-driving shaft and driver sleeve, such that rotation of the driver sleeve rotates the lock-driving shaft to engage or disengage the ground fastener from the ground. When in second position, if the bore is clear, a pin placed through the bore of the lock-driving shaft will lock out the driver sleeve from rotationally latched engagement with the lock-driving shaft. If the catch is clear, a pin placed through the catch of the driver sleeve will lock out the lock-driving shaft from rotationally latched engagement with the driver sleeve.

Still another aspect of the invention provides a ground lock for securing an object to the earth. The ground lock is formed of a longitudinal shaft having an upper portion and a lower portion, configured with a first transverse bore extending through the shaft in its upper portion. The lower portion of the shaft carries a ground-fastening device that is adapted to penetrate into or be removed from the ground for alternatively engaging with or disengaging from the ground. The ground lock also includes a locking pin. The upper portion of the longitudinal shaft carries a driver that includes longitudinally slidable sleeve engaged over the shaft and defining a second transverse bore. When the sleeve is positioned at a first height on the shaft, the second transverse bore is alignable with the first transverse bore such that the locking pin can be inserted through the aligned bores to lock the driver and shaft for rotation in unison, whereby the driver can rotate the shaft to alternatively engage or disengage the ground-fastening means with the ground. When the sleeve is positioned at a second height on the shaft, the two bores are offset from one another with one bore clear such that the locking pin can be inserted through the one bore to lock out the sleeve against return movement to the first height. Thus, the driver and shaft cannot be locked through the aligned bores for rotation in unison, whereby the driver cannot rotate the shaft to disengage the ground fastening means from the ground. The driver further includes a handle portion configured as a closed loop suitable for securing an object to the earth.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

The invention is an apparatus 10 for engaging the ground or any other soft surface to serve as an anchor for securing personal property to help deter theft. An area of particular usefulness for such a device is a beach, where the apparatus 10 can be anchored into beach sand and used to secure a bather's personal property while the bather is away from the site. The portability of the apparatus 10 is an advantage. It is desirable that the apparatus 10 be easy to transport and be assembled in such a way that component parts cannot be lost during transport. Therefore, no assembly is required, no lug wrenches or other separate insertion tools are needed, and the apparatus is lightweight.

Figure 1:
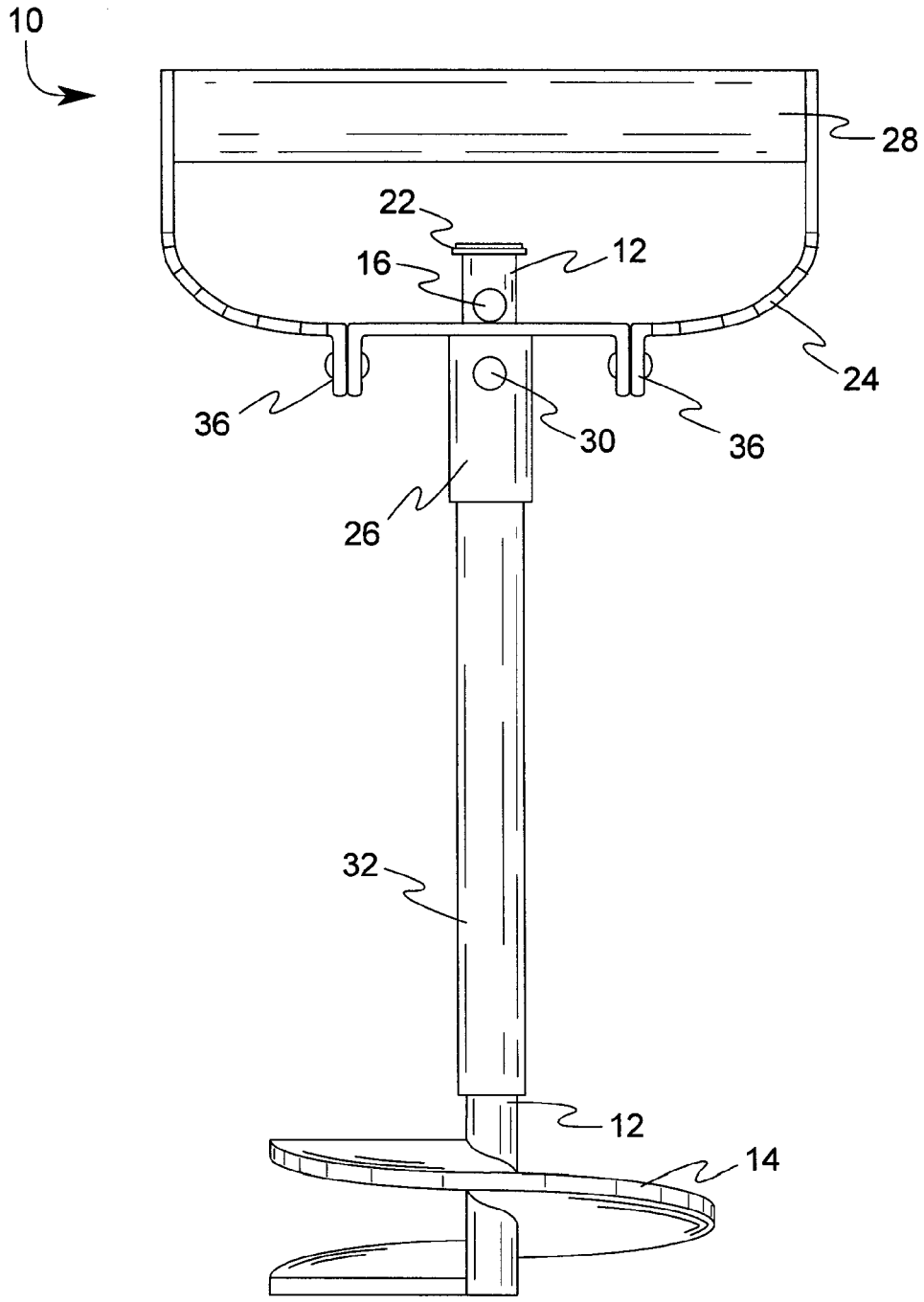
FIG. 1 is a front elevational view of a ground lock.
Figure 6:
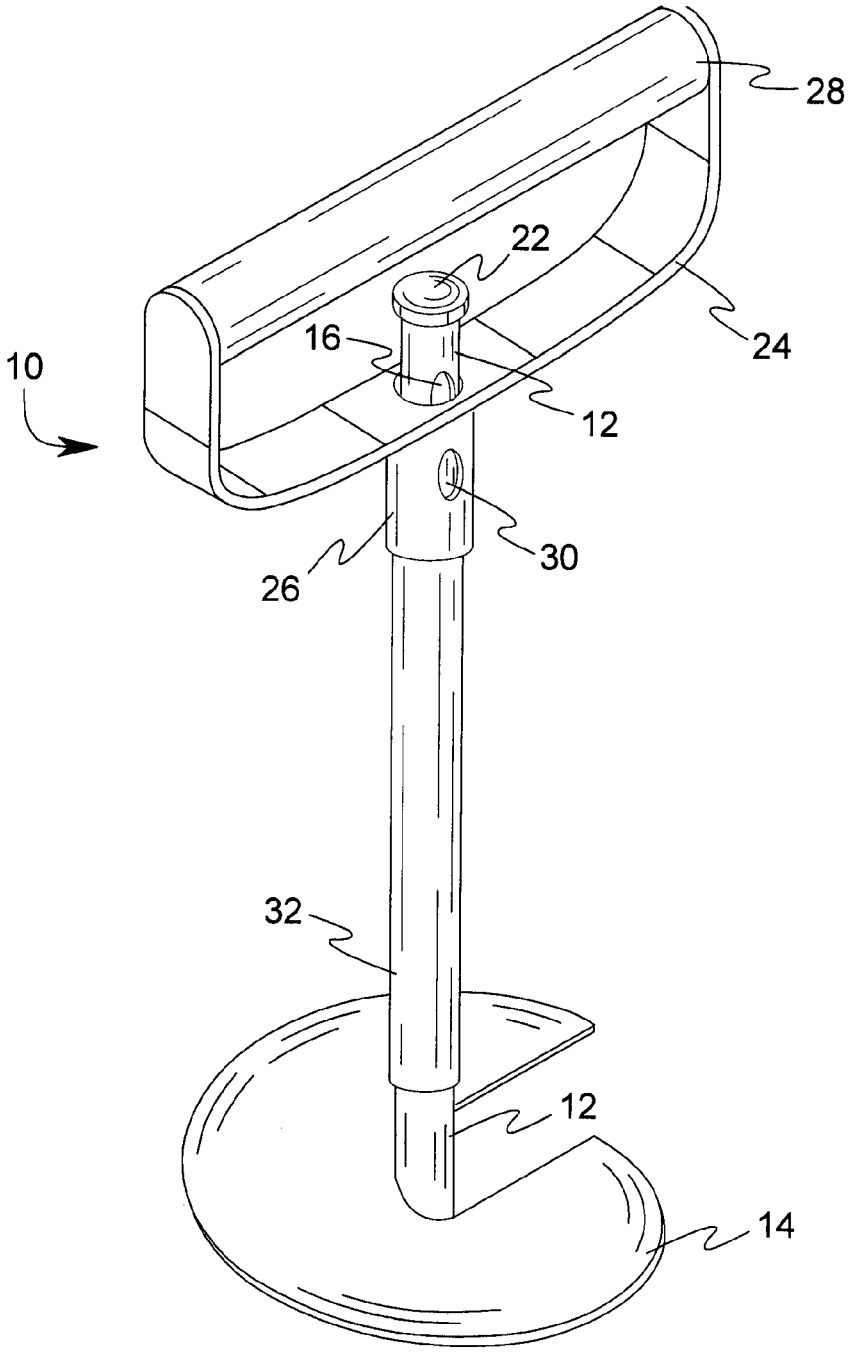
FIG. 6 is an isometric view of the ground lock, taken from the rear upper right viewpoint.

With reference to FIGS. 1 and 6, the apparatus 10 can be referred to as a ground lock, beach lock, or sand lock. For convenience of description the apparatus hereinafter will be referred to as a sand lock. A main shaft 12 serves as a fastener-driving shaft that allows the sand lock 10 to be engaged and disengaged from earth, sand, or similar materials. The shaft 12 is longitudinally elongated between proximal and distal ends, which also may be referred to as an upper end and a lower end. The main shaft 12 may be either solid or tubular.

A ground fastening means 14 is carried on the lower end or distal portion of the shaft 12. The configuration of fastener 14 is suitable to penetrate into or be removed from the ground for alternatively engaging with or disengaging from the ground when suitably driven. One embodiment of the ground fastener is as an auger blade, as shown in FIGS. 1 and 6. The auger blade 14 can be attached to the main shaft by weldment. Another suitable configuration is as a spiral screw. Both an auger blade and a spiral screw are inserted into the ground by twisting shaft 12 in a first direction. Either type of fastener 14 is removed from the ground by reverse-twisting shaft 12.

The main shaft 12 includes a first latching structure that is a means for rotationally fixing the main shaft to a driver. According to FIGS. 1-8, the first latching structure is conveniently located near the upper or proximal end of the main shaft. An example of the first latching structure is a first transverse bore 16 located below the top end of the main shaft. The bore is sized to receive a cooperating through-pin such as a padlock shackle 18, best shown in FIGS. 2 through 5. The through-pin 18 should be both insertable and removable. A padlock 20 providing a shackle 18 is especially suitable because it can be selectively locked to occupy the bore while resisting removal, or unlocked and removed to open the bore. The sand lock is intended for use with a catch, pin, padlock, or other temporary locking device, but such a lock need not be considered to be a part of the invention. In commercial use, the sand lock may be supplied either with or without an associated padlock. Owners and users may prefer to supply their own lock.

Optionally, the top end 22 or proximal end of main shaft 12 is larger than the shaft below the top end. The enlarged head 22 may be a separate retainer or keeper for retaining another component on the shaft. An example of a keeper 22 is a C-clip that is selectively applied to the main shaft 12, or the top end of the main shaft can be configured as a permanent flange. The larger diameter of the keeper prevents a driver 24 from complete separation from the main shaft, so that the driver is not lost.

The driver 24 is configured, in part, as a slidable, driver sleeve 26 that telescopically fits over shaft 12. At least a portion of the driver sleeve 26 is of smaller diameter than keeper 22 so that the keeper retains driver sleeve 26 on main shaft 12. Driver sleeve 26 also provides a second latching structure that cooperates with the first latching structure to rotationally fix main shaft 12 to driver 24, when the two latching structures are suitably positioned and locked together. For example, the second latching structure is a bore 30 through sleeve 26. When not locked to main shaft 12, driver sleeve 26 slidably engages main shaft 12 and is longitudinally moveable on main shaft 12 between a raised position and a lowered position. In at least one available position of driver sleeve 26 on main shaft 12, bore 30 is aligned with bore 16, such that the two bores can be fastened in alignment.

Driver 24 additionally includes handle 28 that extends laterally from driver sleeve 26 and optionally forms a closed loop, which may extend over the top end of main shaft 12. Driver sleeve 26 is suitably shorter than main shaft 12 so that the driver sleeve can move between keeper 22 and ground fastener 14. For example, in the embodiment of FIG. 5, the driver sleeve is in a relatively high position and keeper 22 is engaged against the top of driver sleeve 26. When the keeper is longitudinally engaged in this position, driver 24 can be rotated to place bores 16 and 30 in mutual alignment. A catch or lock, such as a pin or padlock 20, can temporarily latch the two bores in this alignment. Turning driver 24 applies rotary force to ground fastener 14 through the catch and bores.

Figure 2:
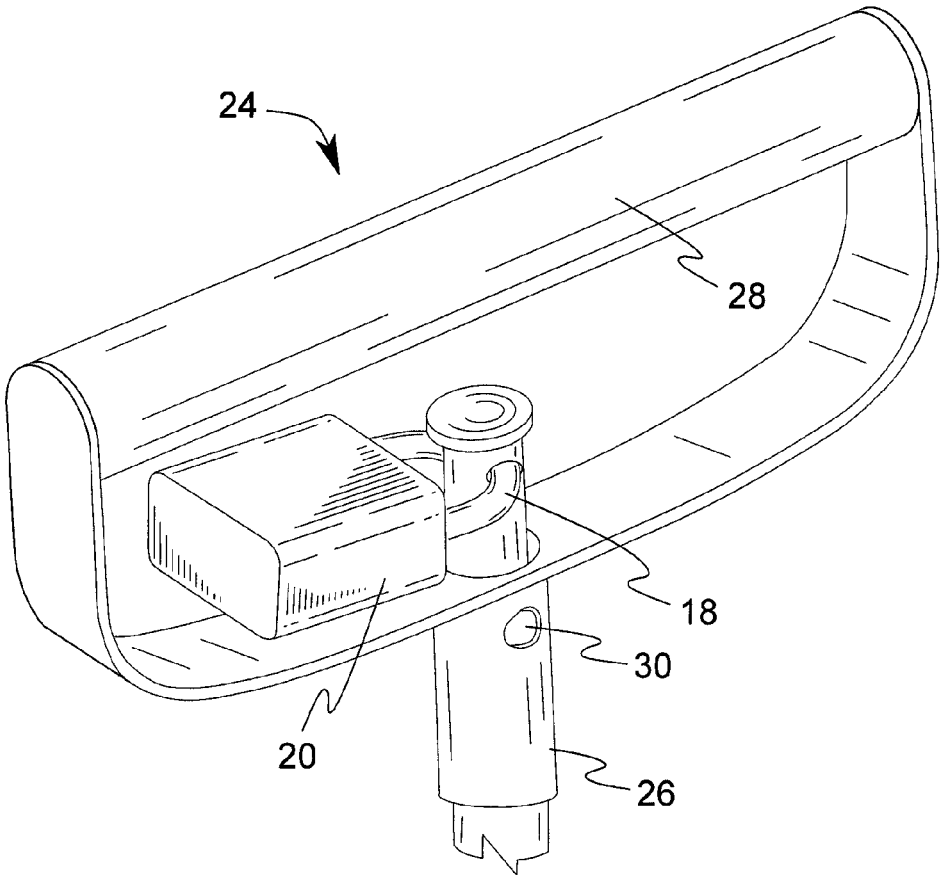
FIG. 2 is a fragmentary isometric view thereof, showing the ground lock in disabled configuration with a padlock.
Figure 3:
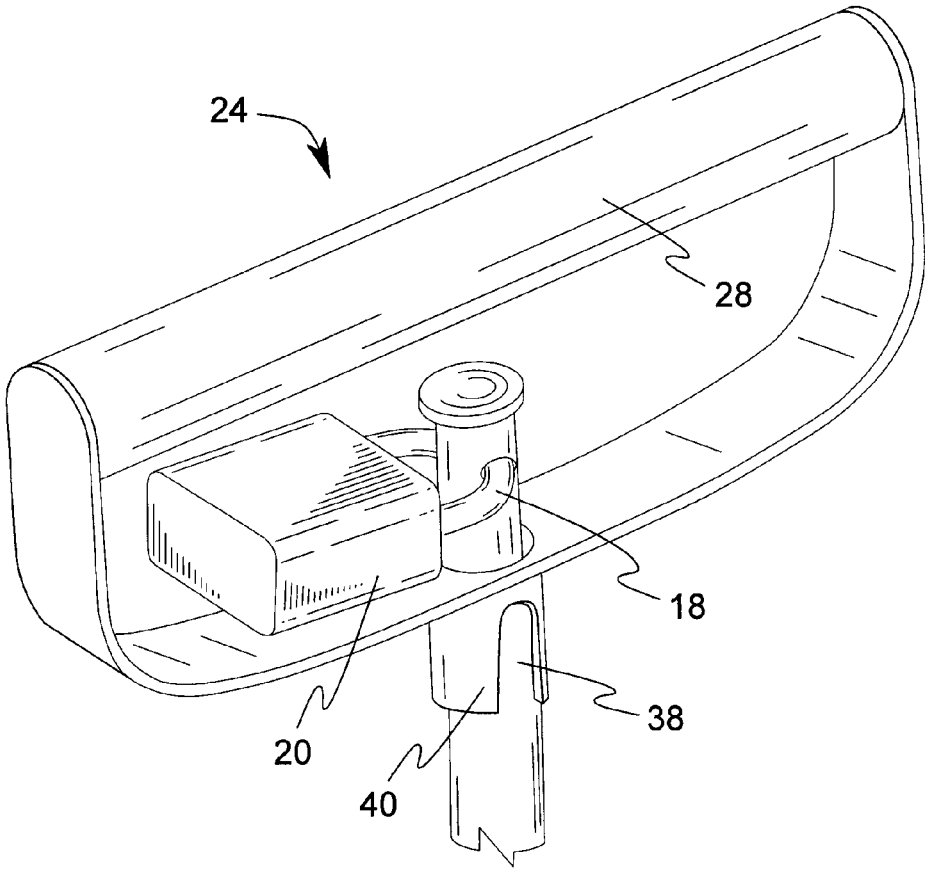
FIG. 3 is a view similar to FIG. 2, showing a second embodiment of the ground lock.
Figure 4:
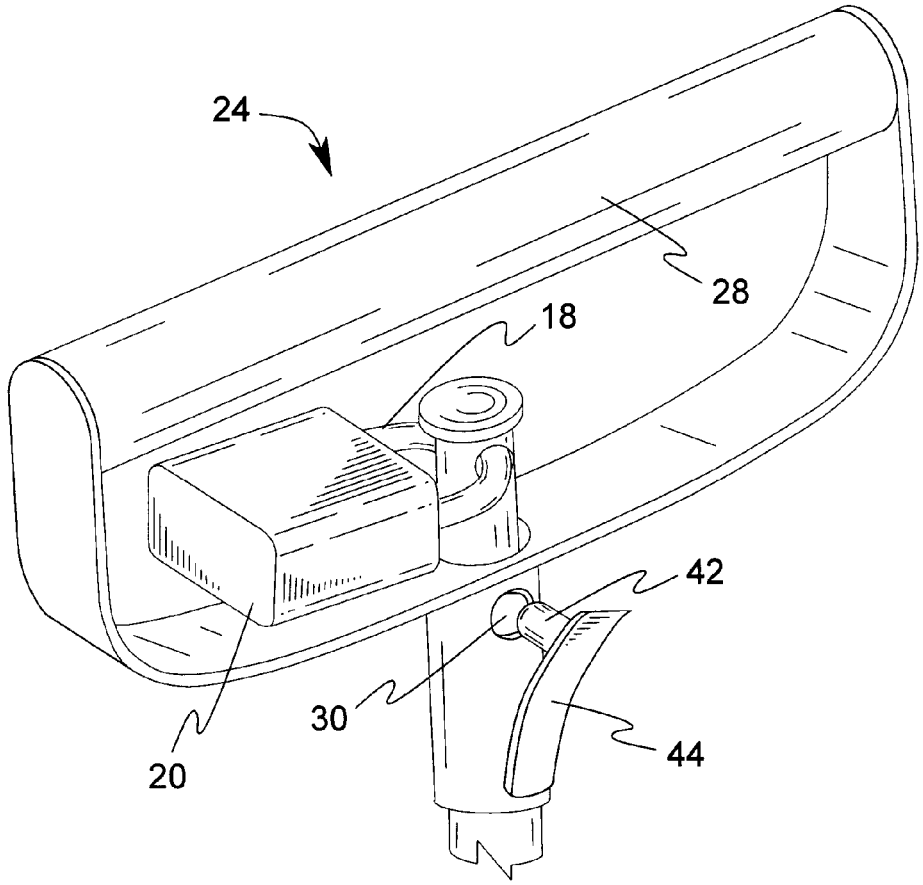
FIG. 4 is a view similar to FIG. 3, showing a third embodiment of the ground lock.
Figure 5:
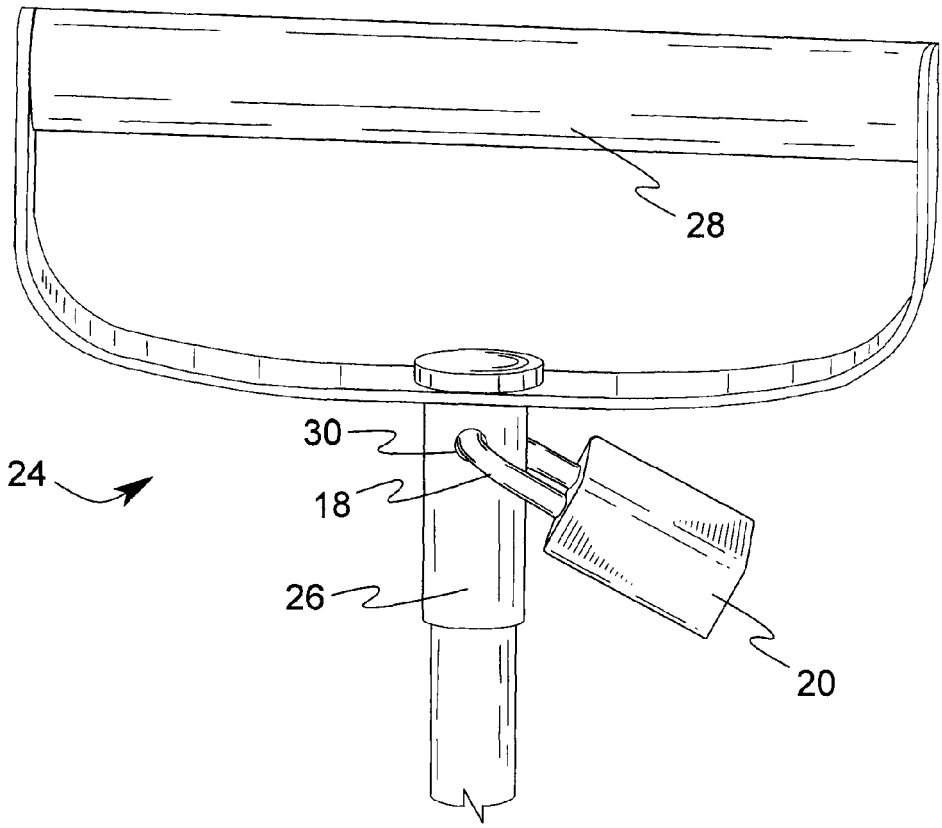
FIG. 5 is a fragmentary isometric view thereof, showing the ground lock in enabled configuration with a padlock.

When the bores are not engaged by a catch, sleeve 26 is both longitudinally slidable and rotatable with respect to main shaft 12. Sleeve 26 may be slidable between the described latching position, as suggested by FIG. 5, and any other position, which will be non-latching. For example, FIGS. 1-4 and 6 show the sleeve to be displaced from latching position. In FIGS. 2-4, the main shaft 12 carries a pin or shackle 18 exclusively through bore 16, effectively locking out the driver sleeve 26 from assuming the latching position. When sleeve 26 is in any non-latching position, driver 24 is disabled from rotating the ground fastener to alternatively engage or disengage the ground.

Together, two bores 16 and 30 define a temporary latch that cooperates with a disengageable catch such as a padlock or pin to perform as a temporary junction between main shaft 12 and sleeve 26. The second transverse bore 30 may be formed near the top end of sleeve 26 for convenient access when the ground lock is in use. Second bore 30 is located at a suitable height or position on sleeve 26 so that it can be aligned with main shaft bore 16 to receive a catch or other common engaging means in aligned bores 16 and 30. Thus, if a keeper 22 at the top of shaft 12 limits the upward position of sleeve 26 when in the latchable position, the position of bore 30 on sleeve 26 is at least high enough to be at the level of bore 16 when the sleeve 26 is in latchable position and contacts the keeper 22.

When sleeve 26 is in non-latchable position on main shaft 12, bores 16 and 30 are offset with respect to one another, with either selected bore above or below the other sufficiently that one of the bores is clear to receive a pin. Main shaft 12 may be sufficiently raised that bore 16 is clear of sleeve 26, or sleeve 26 may be sufficiently raised that bore 30 is clear of main shaft 12. In either case, a padlock or the like can be engaged in the clear bore, thereby locking the clear bore from returning to aligned position. FIGS. 2-4 show main shaft 12 in relatively higher position with locking pin 18 inserted through shaft bore 16 to lock-out sleeve 26 from being raised to locking position. The lock also serves to retain sleeve 26 against removal from shaft 12 regardless of whether keeper 22 is present.

Portions of handle 28 extend laterally of the driver sleeve for mechanical advantage in twisting driver sleeve 26 to operate sand lock 10. The handle also provides a hand grip for carrying sand lock 10. The handle enables a user to simultaneously turn both handle 28 and sleeve 26. When sleeve 26 is locked to shaft 12 by a padlock through bores 16 and 30, the driver 24 will further rotate main shaft 12 and auger 14 to engage or disengage the auger with the ground. Once the sand lock has been installed in the ground, the temporary latching mechanism is disengaged, such as by removing the padlock 20 from bores 16 and 30. Sleeve 26 is then raised or lowered to bring either one of bores 16 and 30 into a clear position. The clear bore is locked out of returning to alignment with the other, resulting in driver 24 being free-spinning from shaft 12. The driver can neither engage nor disengage auger 14 from the ground while in free-spinning mode.

In the drawings, driver sleeve 26 is shown as a very short sleeve by comparison to shaft 12. An optional, longer, intermediate sleeve 32 may fit between shaft 12 and driver sleeve 26. In an optional construction, the intermediate sleeve may be independent of driver sleeve 26, such that the driver sleeve slides over the intermediate sleeve. This longer, intermediate sleeve protects against the use of a wrench or like tool to rotate shaft 12, such as for unauthorized removal of the sand lock from the ground.

Figure 7:
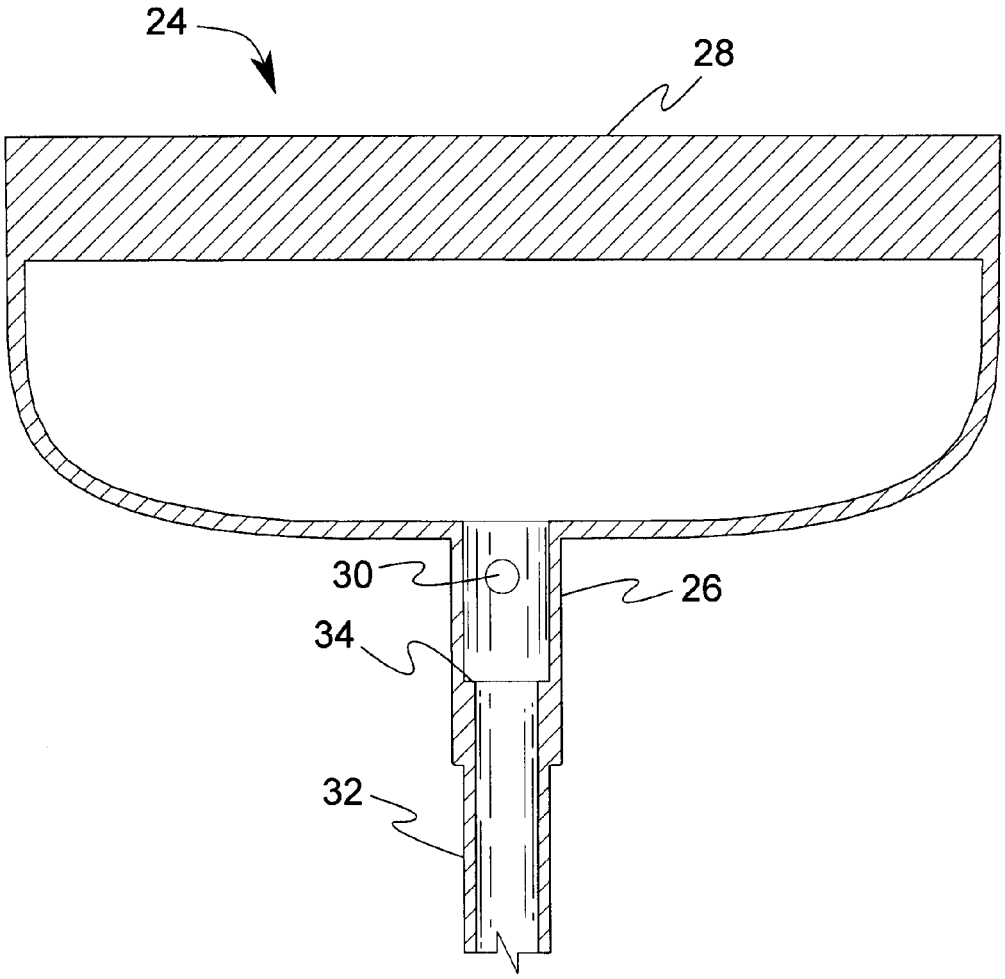
FIG. 7 is a fragmentary front elevational view taken in vertical cross-section, showing a further configuration of the ground lock.
Figure 8:
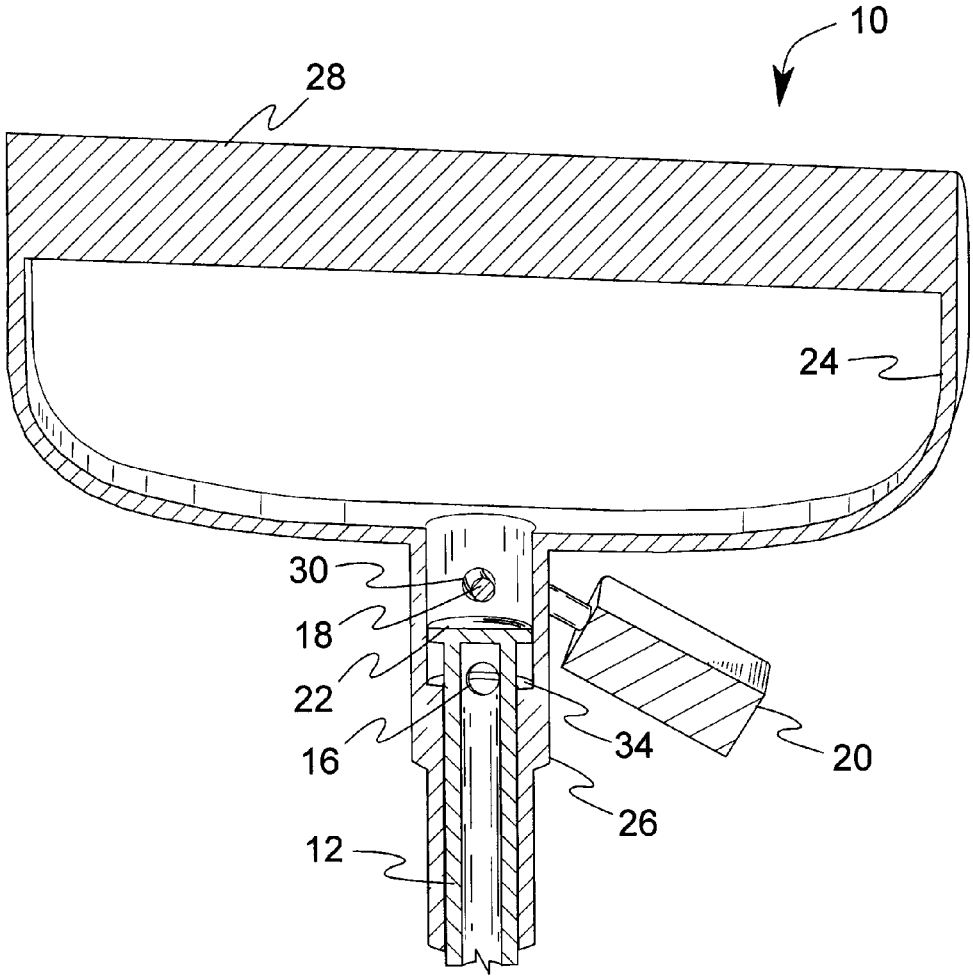
FIG. 8 is an isometric view of the ground lock of FIG. 7 in vertical cross-section, taken from the rear upper right viewpoint, showing additional details of the configuration of FIG. 7.

In another alternative, intermediate sleeve 32 is attached to driver sleeve 26. As best shown in FIG. 7, the top edge of intermediate sleeve 32 defines shoulder 34 inside driver sleeve 26. As best shown in FIG. 8, keeper 22 can be sized to fit inside driver sleeve 26 to engage shoulder 34. The top of main shaft 12 can then be sheltered inside driver sleeve 26 when in non-lockable position. Shoulder 34 is positioned low enough in driver sleeve 26 to allow bore 30 to be raised to clear position, as shown in FIG. 8. The combination of driver sleeve 26 and intermediate sleeve 32 is free-spinning and protects the top portion of main shaft 12 from exposure to tools.

Handle 28 may be a closed loop such as the illustrated D-handle 28 in the drawings. The loop of handle 28 provides a convenient location for securing personal property to the sand lock. For example, a cable lock can be passed through the handle loop to secure a bicycle or a cooler to the sand lock. It is generally desirable for sand lock 10 to be stored and carried with the driver 24 locked in operating position, such that driver sleeve 26 is in latched configuration. Having a lock 20 through aligned bores 16 and 30 holds the handle in latched position and protects against accidental contact between the handle and the top of shaft 12. When the sand lock is in use, it is generally desirable for driver 24 to be pressed down into the sand to remove handle 28 from view and from being a protrusion. If desired, the sand can be pushed aside to bury the sand lock 10 during installation. Optionally, as shown in FIG. 1, handle 28 may be foldable on sleeve 26, such as on pivots 36 on opposite sides of sleeve 26.

With reference to FIG. 3, where the temporary latching mechanism has been described as including bores 16 and 30, variations of a bore structure also are suitable. As an example, in FIG. 3, the temporary latching mechanism on sleeve 26 is shown to be a slot or recess 38 with an open bottom, similar to a forked structure. Such a recess may be present at opposite sides of sleeve 26 so that a pin or padlock can engage through this recess and bore 16 to establish the temporarily engaged latch for driving auger 14. As a further example, sleeve 26 can be configured so that a depending ear portion 40 is present on only one side of the recess area. These examples demonstrate that reference to a bore through sleeve 26 can refer to shapes and structures of considerable variation, but that continue to offer equivalent functionality to a bore as shown in FIG. 1.

With reference to FIG. 4, where the disengageable portion of the temporary latching mechanism has been described as a pin or padlock, variations of the temporary latch or catch are also suitable. As an example, a spring biased pin 42 may be located on one or both sides of sleeve 26, in a position to pass through bore 30 and engage in bore 16, when bore 30 is suitable aligned. A spring arm 44 biases pin 42 toward shaft 12. When sleeve 26 is in lowered position as illustrated in FIG. 4, pin 42 rests against shaft 12 through bore 30 without latching to the main shaft. This example demonstrates that reference to a pin or padlock that temporarily latches sleeve 26 to shaft 12 can refer to structures with considerable variation, but that continue to offer equivalent functionality to a through-pin or padlock shackle. In the case of the spring biased pin 42, the example further shows that a lock is not necessary when the driver 24 is engaged to turn the main shaft. The lock is desired only to perform the lock-out function.

The sand lock is suitable for individual ownership and use. It is compact and efficient in structure such that an individual user will find it convenient to carry to the beach. The user can align bores 16 and 30, and then insert a padlock through aligned bores 16 and 30 to engage driver 24. A few twists on handle 28 will engage auger 14 into the sand. The user then removes the padlock from the aligned bores and raises or lowers handle 28 to move either of the bores 16, 30 to clear position. By reinserting the padlock through either clear bore 16 or clear bore 30, driver 24 is locked into free spinning condition where turning handle 28 does not disengage the auger from the ground. When the user is preparing to leave the beach, the user removes the padlock from the clear bore 16 or 30, appropriately raises or lowers handle 28 to longitudinally realign bores 16 and 30, twists handle 28 to rotationally align bores 16 and 30, and inserts the padlock through aligned bores 16 and 30. The user is then enabled to reverse twist handle 28 to unscrew auger 14 from ground engagement. The sand lock is easily carried away with the user's other beach equipment.

The sand lock also is suitable for commercial sale or rental at a busy beach. The sand lock operates easily, is highly durable, and the parts are secured against loss even when no padlock is in use. Thus, a shop at the beach can handle the rental or sale of sand locks with little concern for lost parts or breakage, and the shop need not supply the padlock. The user is able to use his own padlock for personal security.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A ground lock providing an attachment for securing an external object, comprising:

a vertically elongated main shaft having upper and lower ends, having a ground fastener fixed to said lower end thereof, configured to alternatively engage or disengage the ground when suitably driven, the main shaft having a first latching structure, and wherein said main shaft includes an upper portion of a predetermined, relatively smaller transverse dimension with a head juxtaposed at the top thereof having a predetermined, relatively larger transverse dimension;

a driver including a second latching structure, engaging the main shaft for longitudinal movement thereon between first and second relative longitudinal positions, wherein in said first longitudinal position said first and second latching structures are latchably positioned for said driver to drivingly engage said main shaft and suitably drive said ground fastener through the first and second latching structures to alternatively engage or disengage the ground, and wherein in said second longitudinal position the first and second latching structures are mutually non-latchably positioned, disabling the driver from drivingly engaging the main shaft from suitably driving the ground fastener through the first and second latching structures;

said driver includes a driver sleeve that is slidably engaged on a portion of the main shaft;

said driver sleeve includes a lower portion of predetermined, relatively smaller transverse dimension sized to pass said upper portion of the main shaft but not said head, and a juxtaposed upper portion of predetermined, relatively larger transverse dimension sized to pass said head:

wherein said second latching structure is spaced above said lower portion of the driver sleeve sufficiently that in said second longitudinal position said head is receivable between the second latching structure and the lower portion of the driver sleeve, containing the head of the main shaft within the driver sleeve.

2. The ground lock of claim 1, further comprising:

a lock engagable in said second latching structure when said driver sleeve is in said second longitudinal position, maintaining said head between the second latching structure and the lower portion of the driver sleeve, thereby protecting the head against unauthorized access.

3. The ground lock of claim 1, further comprising:

an attachment member that includes said driver sleeve;

wherein:

said first latching structure is a first transverse bore; and said second latching structure is a portion of said driver sleeve suited to cooperate with said first transverse bore in locking together the driver sleeve and main shaft such that the attachment member can suitably drive said ground fastener.

4. The ground lock of claim 3, wherein:

said second latching structure is a second transverse bore through said driver sleeve, positioned to be alignable with said first transverse bore such that the aligned bores can, in use, be pinned in common to lock together the driver sleeve and main shaft.

5. The ground lock of claim 4, further comprising:

a pin sized for pinning together said aligned first and second transverse bores.

6. A ground lock, comprising:

a ground lock-driving shaft having opposite proximal and distal ends;

a ground fastener carried on said ground lock-driving shaft near the distal end thereof;

a driver sleeve having opposite proximal and distal ends aligned with those of the ground lock-driving shaft, telescopically engaged over said ground lock-driving shaft and longitudinally slidable thereon between a first position on the ground lock-driving shaft and a second position longitudinally offset toward the proximal end of the ground lock-driving shaft from said first position;

wherein said ground lock-driving shaft defines a first transverse bore near the proximal end thereof, suited, in use, to receive a pin therethrough;

wherein said driver sleeve defines a catch suited, in use, to latch with a transverse pin and is alignable with said first transverse bore when in said first position of the driver sleeve on the ground lock-driving shaft such that a transverse pin latched with said catch is receivable through the first transverse bore;

wherein when the driver sleeve is in said second position, the catch is exposed above the proximal end of the ground lock-driving shaft;

whereby in the first position, in use, a transverse pin placed through the first bore of the ground lock-driving shaft is latchable with said catch of the driver sleeve to form a rotationally latched engagement between the ground lock-driving shaft and driver sleeve, such that rotation of the driver sleeve rotates the ground lock-driving shaft to engage or disengage the ground fastener from the ground, and in the second position, in use, a pin placed through the catch of the driver sleeve will lock out the driver sleeve from rotationally latched engagement with the ground lock-driving shaft.

7. The ground lock of claim 6, further comprising:

a keeper carried on said ground lock-driving shaft near the proximal end thereof, sized to retain said driver sleeve against removal from the proximal end of the lock-driving shaft.

8. The ground lock of claim 7, wherein said driver sleeve further comprises:

a handle extending laterally of the driver sleeve for twisting the driver sleeve.

9. The ground lock of claim 8, wherein said handle has a closed loop configuration for providing an attachment to secure external objects.

10. The ground lock of claim 6, wherein said catch is a second transverse bore through said driver sleeve.

11. The ground lock of claim 6, wherein said catch is a forked distal end of said driver sleeve.

12. The ground lock of claim 6, wherein said catch is an ear extending distally from the distal end of said driver sleeve.

13. A ground lock for securing an object to the earth, comprising:

a longitudinal shaft having a top end, an upper portion, and a lower portion, configured with a first transverse bore extending through said shaft in the upper portion thereof;

ground-fastening means carried on said lower portion of said shaft and adapted to penetrate into or be removed from the ground for alternatively engaging with or disengaging from the ground;

a locking pin;

a driver carried on said upper portion of the shaft, including a longitudinally slidable sleeve engaged over the shaft, defining a second transverse bore;

wherein when the slidable sleeve is positioned at a first height on the shaft, the second transverse bore is alignable with said first transverse bore such that said locking pin can be inserted through the aligned bores to lock the driver and shaft for rotation in unison, whereby the driver can rotate the shaft to alternatively engage or disengage the ground-fastening means with the ground; and wherein when the slidable sleeve is positioned at a second height on the shaft, the second transverse bore is above the top end of the shaft and the locking pin can be inserted through the second bore to lock out the slidable sleeve against movement to the first height, preventing the driver and shaft from being locked through the aligned bores for rotation in unison, whereby the driver cannot rotate the shaft to disengage the ground-fastening means from the ground; and wherein said driver further comprises a handle portion configured as a closed loop suitable for securing an object to the earth.

14. The ground lock of claim 13, wherein:

said ground-fastening means comprises an auger and said handle portion is suitably configured for hand engagement to rotate said auger when the driver and shaft are locked for rotation in unison.

15. The ground lock of claim 13, wherein:

said slidable sleeve has an upper portion of a relatively larger transverse dimension and a lower portion of relatively smaller transverse dimension; and further comprising a keeper at said top end of said shaft, sized to fit within said upper portion of the slidable sleeve and to retain the lower portion of the slidable sleeve below the keeper.

16. The ground lock of claim 15, wherein:

said second transverse bore is formed in said upper portion of said slidable sleeve.

17. The ground lock of claim 15, wherein said slidable sleeve further comprises:

an upper sleeve forming said portion of the slidable sleeve having a larger transverse dimension;

a lower sleeve forming said portion of the slidable sleeve having a smaller transverse dimension; and a junction where telescoped lengths of said upper and lower sleeves overlap and a top end of the lower sleeve defines a centrally extending shoulder within the upper sleeve, sized to retain said keeper.

18. The ground lock of claim 13, wherein said locking pin comprises a padlock.

* * * * *